US007093413B1

(12) United States Patent
Hughes

(10) Patent No.: US 7,093,413 B1
(45) Date of Patent: Aug. 22, 2006

(54) HARNESS SYSTEM

(76) Inventor: Gabriel T. Hughes, P.O. Box 852, Avondale, AZ (US) 85323

( * ) Notice: Subject to any disclaimer, the term of this patent is extended or adjusted under 35 U.S.C. 154(b) by 0 days.

(21) Appl. No.: 10/827,734

(22) Filed: Apr. 19, 2004

Related U.S. Application Data

(60) Provisional application No. 60/463,552, filed on Apr. 17, 2003.

(51) Int. Cl.
*B68C 1/02* (2006.01)

(52) U.S. Cl. ..... 54/44.1; 297/465; 297/485

(58) Field of Classification Search ..... 54/1, 54/44.1; 297/465, 485; 119/770, 771; 434/253, 434/255

See application file for complete search history.

(56) References Cited

U.S. PATENT DOCUMENTS

| | | | | | |
|---|---|---|---|---|---|
| 2,170,703 | A | * | 8/1939 | Waxman et al. | 2/49.4 |
| 3,099,486 | A | * | 7/1963 | Scott | 297/465 |
| 4,018,478 | A | * | 4/1977 | Fiala et al. | 297/471 |
| 4,026,245 | A | * | 5/1977 | Arthur | 297/465 |
| 5,029,434 | A | * | 7/1991 | Erickson | 54/44.1 |
| 5,267,352 | A | * | 12/1993 | Rodarmel | 2/44 |
| 5,901,531 | A | * | 5/1999 | Rogers | 54/44.1 |

* cited by examiner

*Primary Examiner*—Robert P. Swiatek
(74) *Attorney, Agent, or Firm*—Stoneman Law Offices, Ltd.; Martin L. Stoneman; Benjamin K. Erlick

(57) ABSTRACT

A harness system for aiding a mounted rider in maintaining a substantially upright position during a riding procedure. Additionally, it specifically provides a harness system that aids a rider in maintaining a substantially upright position in the saddle during the delivery of a roping procedure.

17 Claims, 6 Drawing Sheets

HARNESS SYSTEM

CROSS-REFERENCE TO RELATED APPLICATION

The present application is a continuation-in-part of related prior provisional application Ser. No. 60/463,552, filed Apr. 17, 2003, entitled "HARNESS SYSTEM", the contents of which are incorporated herein by this reference and are not admitted to be prior art with respect to the present invention by the mention in this cross-reference section.

BACKGROUND

This invention relates to providing a system for improved body alignment while riding a horse, particularly while training as a heeler in the sport of team roping. In the sport of team roping, there are two ropers. One roper, the header, is responsible for roping the horns of the steer or calf, while the second roper, the heeler, is then responsible for roping the legs of the steer or calf. The horse is typically moving in a forward direction when the heeler is roping the legs of the steer or calf. The heeler adjusts the delivery of the rope with the speed of the steer or calf and the speed of the horse. Therefore, when the delivery of the rope is altered in some fashion, either by the speed of the horse or angle of delivery, the rope frequently misses the intended target.

Typically, a heeler misses the intended target because the heeler/roper leans forward into the roping action. Leaning forward shifts the weight on the horse's back may cause the horse to stop or slow because of the horse's training. Therefore, it is desired to have the roper maintain a substantially upright position in the saddle when delivering the rope to its intended target. Additionally, and perhaps even more importantly, the height and angle from which the rope is thrown changes as the angle of uprightness of the heeler/roper changes, thereby interfering with the accuracy of the thrown rope. Moreover, over and above roping, the ability for a rider to hold an upright and balanced posture at all times is often critical for optimal rider control and horse performance in any equestrian activity. This is especially true during classical dressage riding and jumping. The smallest shift in the rider's center of gravity, resulting from a loss of proper alignment, may compromise the rider's control of the horse. Perhaps even more importantly, good posture is required for best rider appearance during equestrian competitions. Therefore, there is a need for a system to aid riders to maintain proper posture.

Additionally, use of the present invention is not limited to equestrian activities. The present invention may also be used on mounts, such as, camels, mules, etc.

OBJECTS AND FEATURES OF THE INVENTION

A primary object and feature of the present invention is to provide a system for aiding a rider in maintaining a substantially upright position in a saddle during a riding procedure.

It is a further object and feature of the present invention to provide such a system that also aids a rider in maintaining a substantially upright position in the saddle during the delivery of a roping procedure, particularly in team roping where the roper/heeler has a tendency to lean into the delivery which often causes the roper to miss the intended target.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a harness system for maintaining an upper torso of a rider, on a seat on a mount and adjacent at least one anchor substantially stationary with respect to the seat, in an upright position, comprising, in combination: harness means for harnessing such upper torso; attachment means, comprising at least one first end and at least one second end, for attaching such harness means to such at least one anchor; first connection means for connecting such at least one first end of such attachment means to such harness means; second connection means for connecting such at least one second end of such harness means to such at least one anchor; wherein such at least one attachment means comprises tension means for impeding primarily forward movement of such upper torso in such manner as to keep such upper torso in an upright position. Moreover, it provides such a system wherein such seat comprises a saddle.

Additionally, it provides such a system wherein such at least one anchor comprises at least one portion of such saddle. Also, it provides such a system wherein such at least one portion of such saddle is selected from the group of saddle portions consisting of: the cantle, top leather portion of cantle, rear jockey, skirt, strings. In addition, it provides such a system wherein such harness means comprises fabric means. And, it provides such a system wherein such harness means comprises at least one adjustable strap and at least one closure. Further, it provides such a system wherein such harness is removably secured on such rider by such at least one adjustable strap and such at least one closure. Even further, it provides such a system wherein such tension means comprises stretchable surgical tubing. Moreover, it provides such a system wherein such tension means is adjustable in a plurality of locations on such attachment means. Additionally, it provides such a system wherein such attachment means comprises at least one quick-release connector. Also, it provides such a system wherein such at least one quick-release connector comprises at least one hook and loop fastener. In addition, it provides such a system wherein such second connection means comprises at least one metal bracket.

In accordance with another preferred embodiment hereof, this invention provides a harness system for maintaining an upper torso of a rider, on a seat on a mount and adjacent at least one anchor substantially stationary with respect to the seat, in an upright position, comprising, in combination: at least one harness adapted to harness such upper torso; at least one attachment, comprising at least one first end and one second end, adapted to attach such at least one harness to such at least one anchor; at least one first connector adapted to connect such at least one first end of such at least one attachment to such at least one harness; at least one second connecter adapted to connect such at least one second end of such at least one harness to such at least one anchor; wherein such at least one attachment comprises at least one tensioner for impeding primarily forward movement of such upper torso in such manner as to keep such upper torso in an upright position. And, it provides such a system wherein such seat is a saddle. Further, it provides such a system wherein such at least one anchor comprises such at least one portion of a saddle. Even further, it provides such a system wherein such at least one portion of such saddle is selected from the group of saddle portions consisting of: the cantle, top leather portion of cantle, rear jockey, skirt, strings. Moreover, it provides such a system wherein such harness comprises at least one fabric. Additionally, it provides such a system wherein such harness means comprises at least one adjustable strap and at least one closure. Also, it provides such a system wherein such harness is removably secured on such rider by such at least one adjustable strap and such at least one closure. In addition, it provides such a system wherein such harness is removably secured on such rider by such at least one adjustable strap and such at least one closure. And, it provides such a system wherein such at least one tensioner comprises stretchable surgical tubing. Further, it provides such a system wherein such at least one tensioner is adjustable in a plurality of locations on such at least one attachment. Even further, it provides such a system wherein such at least one attachment comprises at least one quick-release connector. Even further, it provides such a system wherein such at least one quick-release connector comprises at least one hook and loop fastener. Even further, it provides such a system wherein such second connector comprises at least one metal bracket.

In accordance with another preferred embodiment hereof, this invention provides a harness system for maintaining an upper torso of a rider, on a saddle on a mount and adjacent at least one anchor substantially stationary with respect to the seat, in an upright position, comprising, in combination: at least one harness adapted to harness such upper torso; at least one saddle comprising at least one anchor; at least one restrainer, comprising at least one detachably-mounted connector, structured and arranged primarily to restrain such upper torso from forward movement in such manner as to keep such upper torso in an upright position; wherein such at least one harness is removably-securable on such rider; wherein such at least one restrainer comprises: such at least one detachably-mounted connector, at least one quick-release connector, and at least one tensioner; wherein such at least one restrainer is attached to such at least one harness with such at least one quick-release connector and to such at least one anchor with such at least one detachably-mounted connector. Even further, it provides such a system wherein such at least one harness comprises at least one adjustable torso strap comprising at least one closure to secure the harness on such rider.

DETAILED DESCRIPTION OF THE BEST MODE AND PREFERRED EMBODIMENTS OF THE INVENTION

Figure 1:
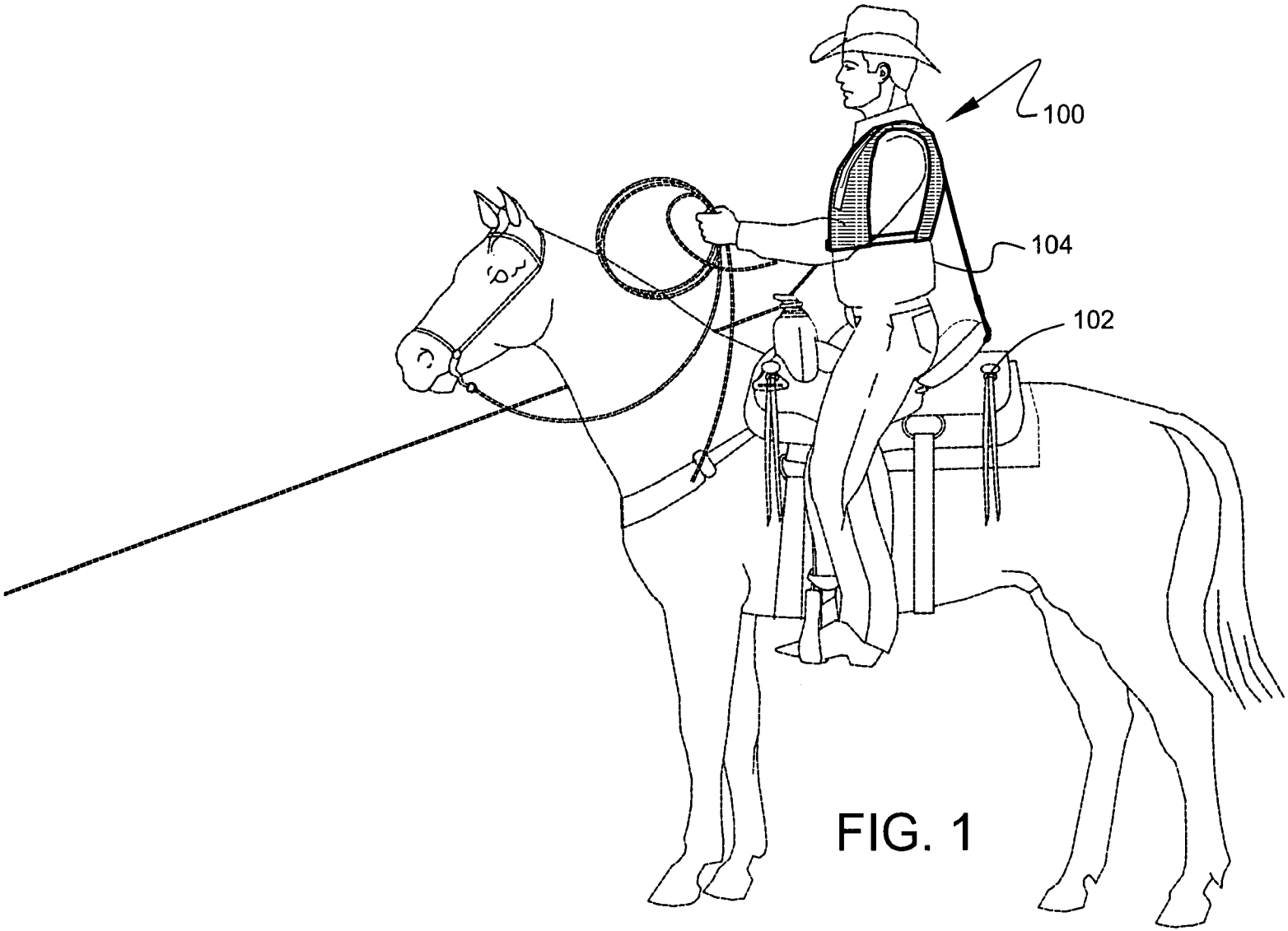
FIG. 1 is a side view of a harness system, as mounted to a saddle, according to a preferred embodiment of the present invention, being used by a rider.

FIG. 1 is a perspective view of harness system 100 as mounted to saddle 102 and being used by rider 104, according to a preferred embodiment of the present invention.

Figure 2:
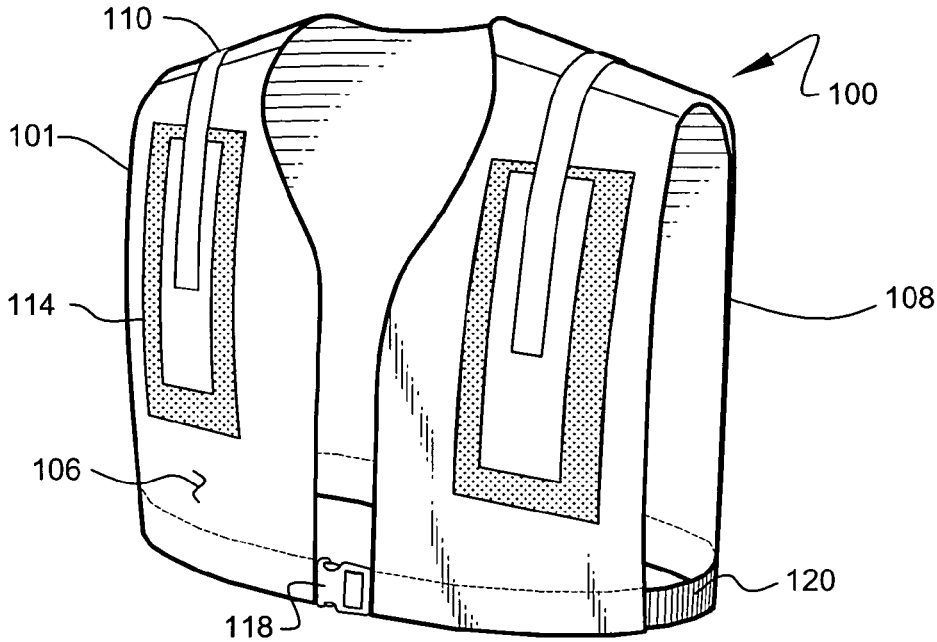
FIG. 2 is a front perspective view of the harness system of FIG. 1.

FIG. 2 is a front perspective view of harness system 100. Harness 101 of the harness system 100 is preferably structured similar to a vest. Preferably, harness 101 is comprised of harness front 106, harness rear 108, upper torso strap 120, and closure 118. Closure 118, as shown, is in a closed or locked position. Additionally, harness system 100 preferably has quick-release connectors 114, depicted in greater detail in FIG. 6, and shoulder straps 110.

Harness 101 is preferably sized to appropriately fit rider 104. Preferably, harness 101 is also adjustable to fit riders of different sizes. Preferably, a larger sized harness 101 would be used to fit an adult-sized rider 104 and a smaller sized harness 101 would be used to fit a child-sized rider 104.

Figure 3:
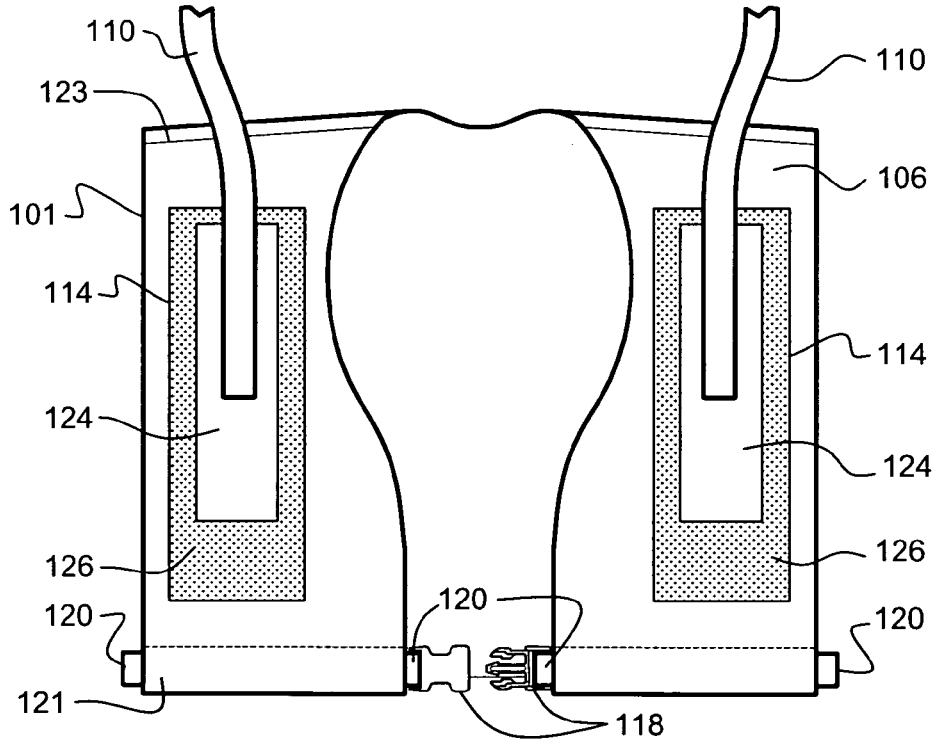
FIG. 3 is a front view of the harness system of FIG. 1.

FIG. 3 is a front view of harness system 100 with closure 118 shown in the open or unlocked position.

Figure 5:
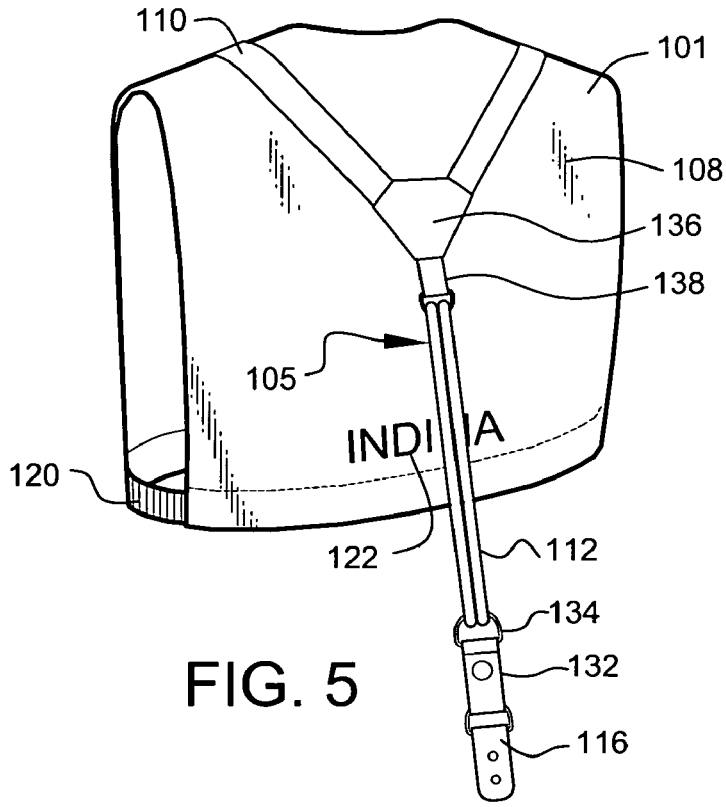
FIG. 5 is a rear perspective view of an alternate preferred rear arrangement of a preferred embodiment of the present invention.

In some circumstances rider 104 may need to quickly release from harness system 100, such as, for example, for safety reasons, etc. For example, if the rider falls off the horse, the quick release connectors automatically detach so that the rider is not dragged by the horse. Preferably, connectors 114 used to connect restrainer 105, as shown in FIG. 5, to harness 101 are of the automatic quick-release type. Preferably, quick-release connectors 114 are comprised of a hook portion of the quick-release connector 124 and a loop portion of the quick-release connector 126 (such as, for example, the hook and loop portions of VELCRO). Upon reading this specification, those skilled in the art will now understand that, under appropriate circumstances, considering issues such as strength, cost of production, durability, etc., other quick-release arrangements, such as, for example, quick-release hooks, snaps, clamps, break-away portions, etc., may suffice.

Additionally, the hook portion of the quick-release connector 124, in the preferred embodiment of this invention, is preferably attached to the shoulder strap 110 by sewing or stitching. Upon reading this specification, those skilled in the art will now understand that, under appropriate circumstances, considering issues such as strength, cost of production, durability, etc., other attaching arrangements, such as, for example, glued, heat fused, etc., may suffice.

The quick-release connectors 124 are preferably sized and positioned such that the resultant connection provides the required effective restraint. As shown, in the preferred embodiment of the present invention, the loop portion of the quick-release connector 126 is preferably positioned on the front of the harness 101 above the upper torso strap 120 and below the shoulder seam 123. Additionally, in the preferred embodiment of the present invention, the loop portion of the quick-release connector 126 is preferably about 4 inches wide by 8-¾ inches long and the hook portion of the quick-release connector 124 is preferably about 2 inches wide by 7-¾ inches long. Upon reading this specification, those skilled in the art will now understand that, under appropriate circumstances, considering issues such as rider size, shoulder strength of the rider, strength of the connector, cost of production, durability, etc., other sizes and arrangements, such as, for example, sized smaller for smaller riders, sized larger for extension of the loop portion of the quick-release connector 126 over the shoulder seam of the harness 101, etc., may suffice.

Preferably, rider 104 wears harness 101 by strapping the adjustable upper torso strap 120 through the strap pocket 121 and attaching it with closure 118. Preferably, the upper torso strap 120 is comprised of woven nylon type strapping/webbing. The closure 118 is preferably a plastic two-part side-release buckle that is sewn onto one end of the upper torso strap 120 and interlaced, for adjustability, on the other end of the upper torso strap 120. Upon reading this specification, those skilled in the art will now understand that, under appropriate circumstances, considering issues such as strength, cost of production, durability, etc., other closure arrangements, such as, for example, snaps, ties, etc., may suffice.

Figure 4:
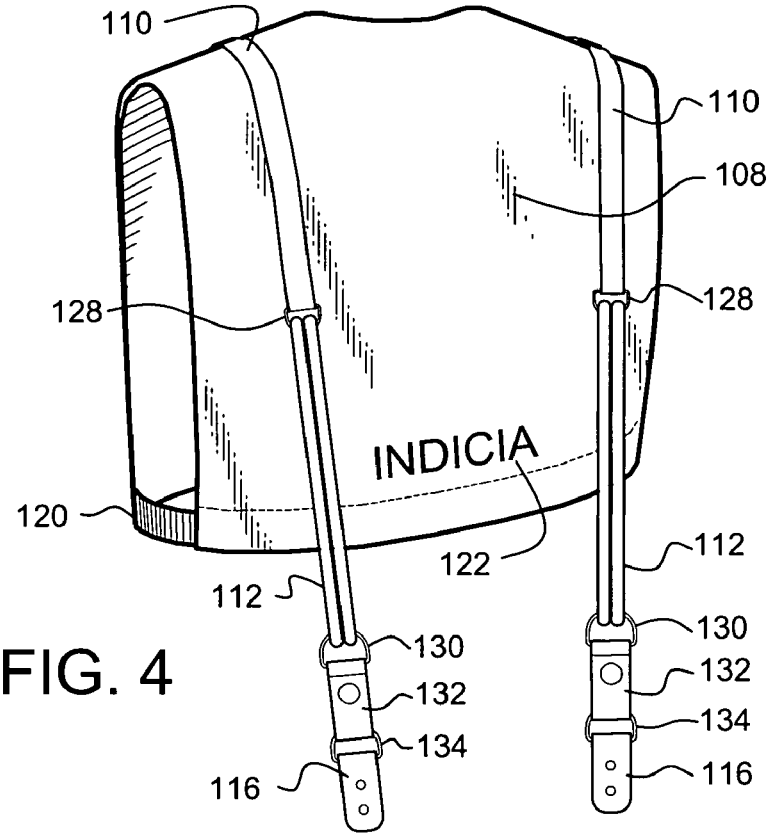
FIG. 4 is a rear perspective view of the harness system of FIG. 1.

FIG. 4 is a rear perspective view of the harness system 100 of FIG. 1. As shown, the harness system is preferably comprised of the harness 101, including the harness rear 108, the retainer 105, and the mounting brackets 116. The retainer 105 preferably consists of the shoulder straps 110, the strap connectors 128, the tensioners 112, the tensioner connectors 130, and the detachable connectors 132. Preferably, the shoulder strap 110 is connected to the tensioner 112 by a strap connector 128, as shown. The preferred embodiment in FIG. 4 shows the use of two sets of tensioners 112, thus, there are two strap connectors 130 connecting the shoulder straps 110 to the tensioners 112.

Additionally, in using two sets of tensioners 112, the preferred embodiment of the present invention also preferably uses two tensioner connectors 130. The tensioner connectors 130 connect the tensioners 112 to two detachable connectors 132. The detachable connectors 132 are preferably connected to the mounting brackets 116 with mount bracket connectors 134.

In this preferred embodiment of the present invention, the strap connectors 128, tensioner connectors 130 and the mount bracket connectors 134 are appropriately-sized metal D-rings. Upon reading this specification, those skilled in the art will now understand that, under appropriate circumstances, considering issues such as strength, cost of production, durability, ease of use, etc., other connector arrangements, such as, for example, snaps, hook and loop fasteners, stitched, integrally formed, etc., may suffice.

The detachable connectors 132, as shown, provide for the ability to remove the restrainer 105 from the mounting brackets 116. This feature allows for the mounting brackets to be semi-permanently or permanently affixed to the saddle 102 or other object being mounted to. Preferably, the detachable connector 132 is comprised of nylon type strapping, preferably 1 inch wide, that is stitched to the tensioner connector 130, looped around the mount bracket connector 134, and connected together with a snap. Upon reading this specification, those skilled in the art will now understand that, under appropriate circumstances, considering issues such as strength, cost of production, durability, etc., other connector arrangements and materials, such as, for example, a snap hook, tied fabric, hook and loop fastener, etc., may suffice.

Figure 11:
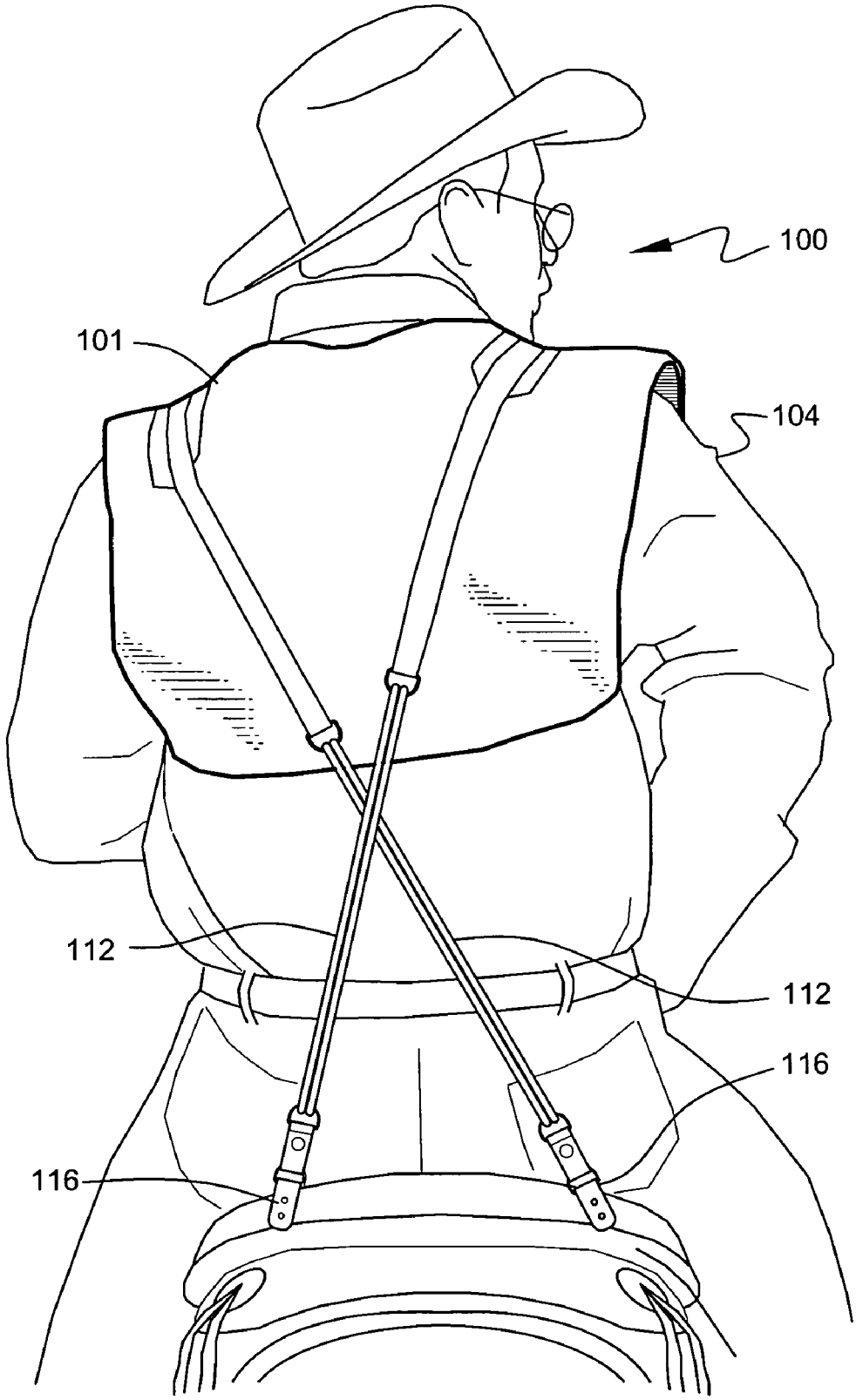
FIG. 11 is a rear perspective view of an alternate preferred embodiment of the present invention.

Preferably, the tensioners 112 are comprised of surgical tubing, looped around the strap connectors 128 and tied onto the tensioner connectors 130. In the preferred embodiment of the invention, the tension resulting from the tensioners 112 can preferably be varied by using fewer or more loops of surgical tubing or by criss-crossing the tensioners 112 across the back of the rider 104, as shown in FIG. 11. Additionally, the desire to vary the tension of the tensioners 112 may depend on the skill level or age of the rider 104. Upon reading this specification, those skilled in the art will now understand that, under appropriate circumstances, considering issues such as size of the rider, strength, cost of production, durability, etc., other tensioner arrangements, such as, for example, stretch cording, or other attachable/removable elastomer, etc., may suffice.

Additionally, the harness rear 108 is preferably sized such that indicia 122 may be placed appropriately for advertising, owner identification, etc.

FIG. 5 is a rear perspective view of an alternate preferred rear arrangement of the harness system 100 of FIG. 1. The harness system 100 in an alternate preferred embodiment of the present invention is preferably comprised of harness 101, including the harness rear 108, the restrainer 105, and mounting bracket 116. The restrainer 105 preferably consists of shoulder straps 110, yoke 136, tab 138, strap connector 128, tensioner 112, tensioner connector 130, and detachable connector 132.

As shown, the restrainer 105 is preferably in the form of a "Y". Depending on the rider 104, the "Y" form of the restrainer 105 may provide sufficient tension and more suitable comfort and flexibility. The yoke 136 is preferably triangularly shaped and positioned such that the wider end is closest to the shoulder straps 110 and the narrower end closest to the tensioner 112. Preferably, the shoulder straps 110 are sewn or stitched onto the yoke 136. In the preferred embodiment of this invention, the yoke 136 is preferably made of a canvas type material similar to that of the harness material. Additionally, in the alternate preferred embodiment of this invention, tab 138 is preferably made of the same strapping material as shoulder straps 110 and is preferably sewn or stitched to yoke 136.

Figure 6:
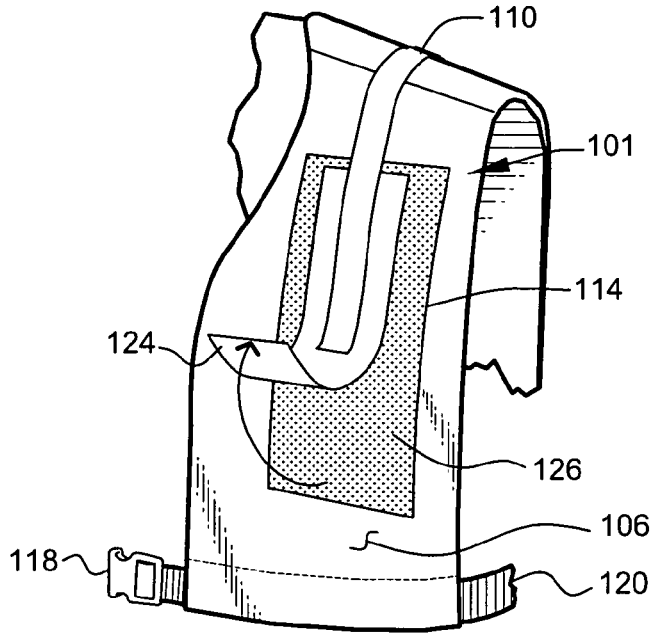
FIG. 6 is a partial perspective view of the front of the harness system of FIG. 1.

FIG. 6 is a partial perspective view of the front of the harness system 100 of FIG. 1. FIG. 6 illustrates the functioning of a quick-release connector 114, as shown. The removal of the hook portion of the quick-release connector 124 from the loop portion of the quick-release connector 126 is depicted by the upward direction of the arrow, as shown.

Figure 7:
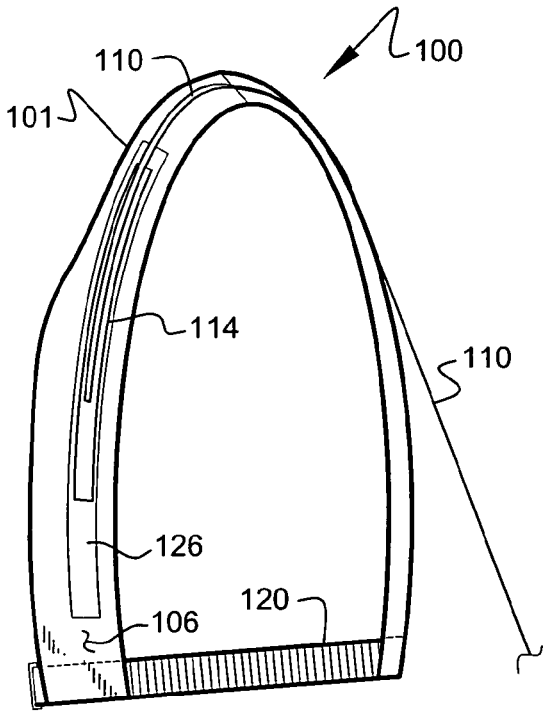
FIG. 7 is a side view of the harness system of FIG. 1, with the shoulder straps in a taut position.

FIG. 7 is a side view of the harness system 100 of FIG. 1, with the shoulder straps 110 in a taut position. As shown, the quick-release connector 114 is essentially layered. The layer closest to the harness 101 is preferably the hook portion of the quick-release connector 126. Placed on the top, or outer side, of the loop portion of the quick-release connector 126 is preferably the hook portion of the quick-release connector 124. Preferably, the shoulder strap 110 is attached, as discussed in the description of FIG. 4, to the top, or outer side, of the hook portion of the quick-release connector 124.

Figure 8:
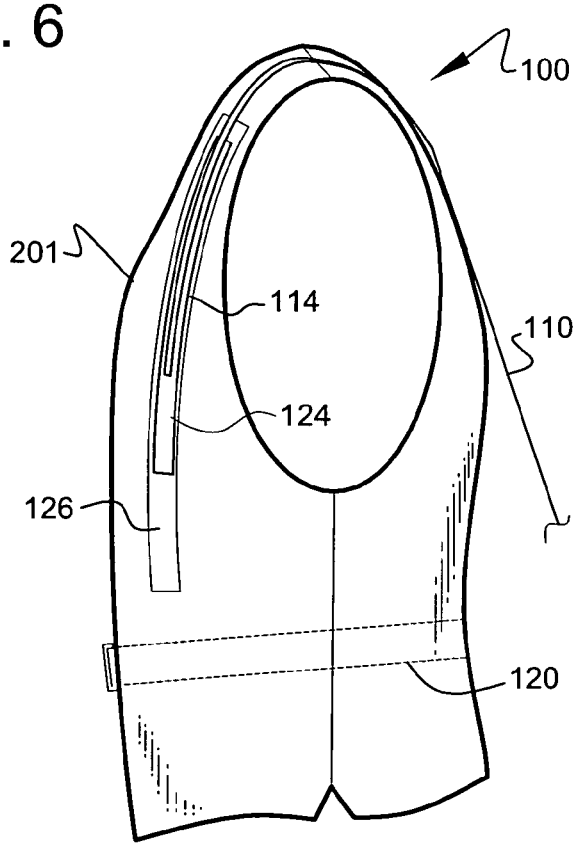
FIG. 8 is a side view illustrating an alternate preferred embodiment of the harness system according to the present invention.

FIG. 8 is a side view illustrating an alternate preferred embodiment of the harness system 100 according to the present invention. As shown, the harness 201 is preferably a full-length vest that ends at essentially the waist of the rider 104, not at the upper torso of the rider 104. In the alternate preferred embodiment of the present invention the upper torso strap 120 and the upper torso strap pocket 121 are preferably on the inside of the harness 101, thus enhancing the look of a full-length harness 201.

Figure 9:
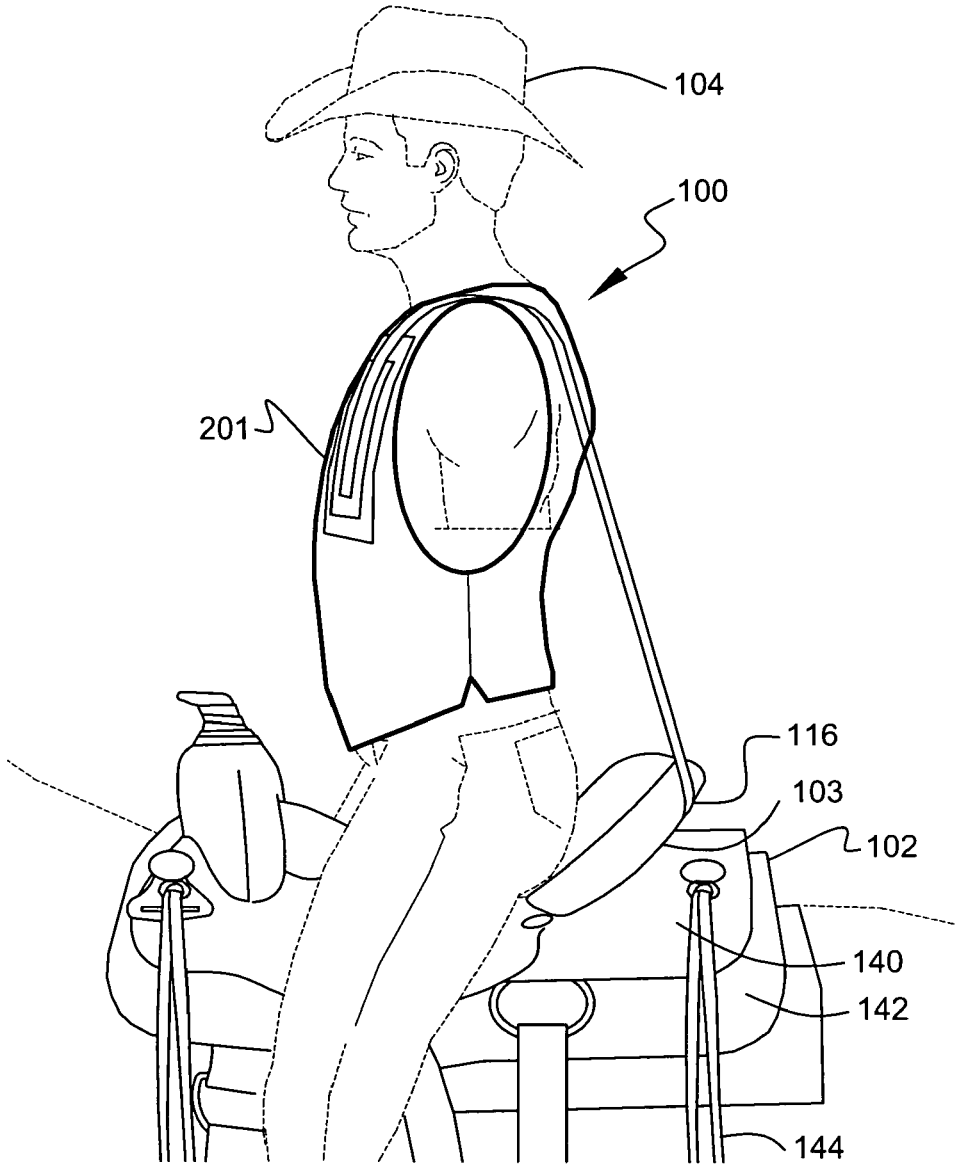
FIG. 9 is a partial diagrammatic side view of the harness system of FIG. 8 being used by a rider and shown mounted to a saddle as in FIG. 1, according to a preferred embodiment of the present invention.

FIG. 9 is a partial diagrammatic side view of the harness system 100 of FIG. 8 being used by a rider 104 and shown mounted to a saddle 102 as in FIG. 1, according to a preferred embodiment of the present invention. As shown, the mounting of the harness system 100, by the mount bracket 116, to the saddle 102 is preferably on the cantle 103 portion of saddle 102. Upon reading this specification, those skilled in the art will now understand that, under appropriate circumstances, considering issues such as strength, cost of production, durability, etc., other mounting arrangements of the saddle 102, such as, for example, an alternate arrangement of the top leather portion of the cantle 148 as shown in FIG. 11, rear jockey 140, skirt 142 or strings 144, etc., may suffice. A more detailed illustration of the mount bracket 116 in relation to the cantle 103 is shown in FIG. 10.

Additionally, the mount bracket 116 is preferably made from light grade steel and preferably provides 2 positions for screw mounting. The mount bracket 116 is preferably flexible to aid rider installation of the mount bracket 116 with ease and in various locations. Upon reading this specification, those skilled in the art will now understand that, under appropriate circumstances, considering issues such as strength, cost of production, durability, etc., other mount materials, such as, for example, any flexible, durable, strong material, etc., may suffice.

Figure 10:
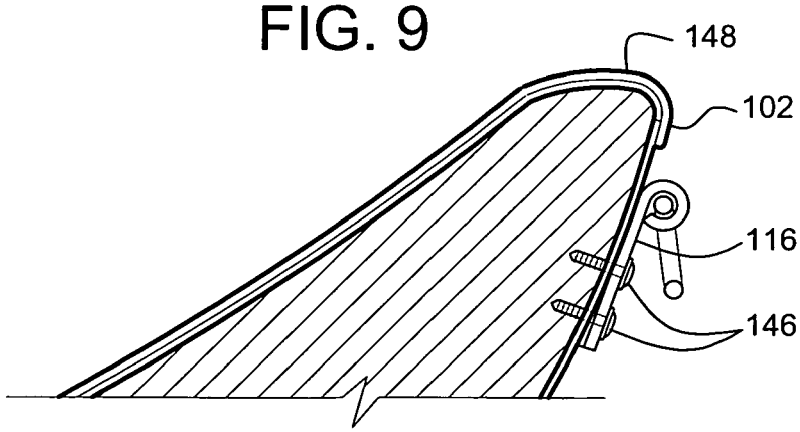
FIG. 10 is a partial sectional view through a mount bracket of a saddle according to the preferred embodiment of the present invention.

FIG. 10 is a partial sectional view through a mount bracket 116 according to the preferred embodiment of the present invention. As shown, the mount bracket 116 is preferably affixed into the underside of the cantle 103 by mount screws 146. This placement of the mounting allows for the mount screws 146 to be inserted into to wood of the cantle 103, preferably permitting a stronger mount. Upon reading this specification, those skilled in the art will now understand that, under appropriate circumstances, considering issues such as rider ease, strength, cost of production, durability, etc., other mounting arrangements, such as, for example, riveted, bolted, etc., may suffice.

FIG. 11 is a photographic perspective view of yet another alternate preferred embodiment of the rear of the harness system 100 of FIG. 1. As discussed in the description of FIG. 4, FIG. 11 shows the tensioners 112 criss-crossed over the back of the rider 104. Also shown, as discussed in the description of FIG. 9, is an alternate mounting of the mount brackets 116 on the top leather portion of the cantle 148 of the saddle 102.

Although Applicant has described Applicant's preferred embodiments of this invention, it will be understood that the broadest scope of this invention includes modifications such as diverse shapes, sizes, arrangements, and materials. Such scope is limited only by the below claims as read in connection with the above specification.

Furthermore, many other advantages of applicant's invention will be apparent to those skilled in the art from the above descriptions and the below claims.

What is claimed is:

1. A harness system, attached to at least one anchor of a seat on a mount, for maintaining an upper torso of a rider in a substantially upright position, comprising, in combination:

a) harness means for harnessing such upper torso;

b) attachment means, comprising at least one first portion and at least one second portion, for attaching said harness means to such at least one anchor;

c) first connection means for connecting said at least one first portion of said attachment means to said harness means;

d) second connection means for connecting said at least one second portion of said harness means to such at least one anchor;

e) wherein said attachment means comprises elastic tension means for impeding forward movement of such upper torso in such manner as to keep such upper torso in a substantially upright position;

f) wherein said attachment means comprises at least one automatic quick-release connector.

2. The system according to claim 1 wherein such seat comprises a saddle.

3. The system according to claim 2 wherein such at least one anchor comprises at least one portion of said saddle.

4. The system according to claim 3 wherein said at least one portion of said saddle is selected from the group of saddle portions consisting of:

a) the cantle, b) top leather portion of the cantle, c) rear jockey, d) skirt, and e) strings.

5. The system according to claim 1 wherein said harness means is removably secured on such rider by at least one adjustable strap and at least one closure.

6. A harness system for maintaining an upper torso of a rider, on a seat on a mount and adjacent at least one anchor substantially stationary with respect to the scat, in an upright position, comprising, in combination:

a) at least one harness adapted to harness such upper torso;

b) at least one attachment, comprising at least one first portion and one second portion, adapted to attach said at least one harness to such at least one anchor;

c) at least one first connector adapted to connect said at least one first portion of said at least one attachment to said at least one harness;

d) at least one second connector adapted to connect said at least one second portion of said at least one harness to such at least one anchor;

e) wherein said at least one attachment comprises at least one elastic tensioner for impeding primarily forward movement of such upper torso in such manner as to keep such upper torso in an upright position;

f) wherein said at least one attachment comprises at least one automatic quick-release connector.

7. The system according to claim 6 wherein such seat comprises a saddle.

8. The system according to claim 7 wherein such at least one anchor comprises at least one portion of said saddle.

9. The system according to claim 8 wherein said at least one portion of said saddle is selected from the group of saddle portions consisting of:

a) the cantle, b) top leather portion of the cantle, c) rear jockey, d) skirt, and e) strings.

10. The system according to claim 6 wherein said harness comprises at least one fabric.

11. The system according to claim 6 wherein said harness means comprises at least one adjustable strap and at least one closure.

12. The system according to claim 11 wherein said harness is removably secured on such rider by said at least one adjustable strap and said at least one closure.

13. The system according to claim 6 wherein said at least one elastic tensioner comprises stretchable surgical tubing.

14. The system according to claim 6 wherein said at least one elastic tensioner is adjustable in a plurality of locations on said at least one attachment.

15. The system according to claim 6 wherein said at least one automatic quick-release connector comprises at least one hook and loop fastener.

16. The system according to claim 6 wherein said second connector comprises at least one metal bracket.

17. A harness system for maintaining an upper torso of a rider, on a saddle on a mount and adjacent at least one anchor substantially stationary with respect to the seat, in a substantially upright position, comprising, in combination:

a) at least one harness adapted to harness such upper torso;

b) at least one saddle comprising at least one anchor;

c) at least one restrainer, comprising at least one detachably-mounted connector, structured and arranged to impede forward movement of such upper torso in such manner as to keep such upper torso in a substantially upright position;

d) wherein said at least one harness is removably-securable on such rider;

e) wherein said at least one restrainer comprises:

i) said at least one detachably-mounted connector, i) at least one automatic quick-release connector, and ii) at least one elastic tensioner; and f) wherein said at least one restrainer is attached to said at least one harness with said at least one quick-release connector and to said at least one anchor with said at least one detachably-mounted connector.

* * * * *

UNITED STATES PATENT AND TRADEMARK OFFICE

CERTIFICATE OF CORRECTION

PATENT NO. : 7,093,413 B1
APPLICATION NO. : 10/827734
DATED : August 22, 2006
INVENTOR(S) : Gabriel T. Hughes It is certified that error appears in the above-identified patent and that said Letters Patent is hereby corrected as shown below:

Column 8, line 7, insert --at least one-- after "wherein said"

Column 8, line 31, "scat" should read --seat--

Column 10, line 11, "i)" should read --ii)--

Column 10, line 12, "ii)" should read --iii)--

Signed and Sealed this

Twenty-first Day of November, 2006

JON W. DUDAS
*Director of the United States Patent and Trademark Office*